US005707254A

United States Patent [19]

Chishima et al.

[11] Patent Number: 5,707,254

[45] Date of Patent: Jan. 13, 1998

[54] TERMINAL AND JOINT CONNECTOR USING THE SAME

[75] Inventors: Masamitsu Chishima; Tomonari Ito, both of Yokkaichi, Japan

[73] Assignee: Sumitomo Wiring Systems, Ltd., Japan

[21] Appl. No.: 651,914

[22] Filed: May 21, 1996

[30] Foreign Application Priority Data

Jun. 16, 1995 [JP] Japan ..... 7-174285

[51] Int. Cl.[6] ..... H01R 13/00

[52] U.S. Cl. ..... 439/679; 439/507; 439/721

[58] Field of Search ..... 439/189, 507, 439/509, 512, 678, 679, 721, 723

[56] References Cited

U.S. PATENT DOCUMENTS

| | | | |
|---|---|---|---|
| 1,012,150 | 12/1911 | Platt | 439/679 |
| 4,171,861 | 10/1979 | Hohorst | 439/513 |
| 5,030,121 | 7/1991 | Noorily | 439/507 |
| 5,035,654 | 7/1991 | Endo | 439/679 |

FOREIGN PATENT DOCUMENTS

| | | | |
|---|---|---|---|
| 4407083 | 9/1994 | Germany | 439/507 |
| 6052953 | 2/1994 | Japan | 439/507 |

OTHER PUBLICATIONS

Japanese disclosure No. HEI 6-333628 (1994) & English translation thereof Abstract only.

Japanese disclosure No. HEI 6-176832 (1994) & English translation thereof Abstract only.

*Primary Examiner*—J. J. Swann

*Attorney, Agent, or Firm*—Jordan B. Bierman; Bierman, Muserlian and Lucas

[57] ABSTRACT

A terminal is enhanced in a spring function of its contact tongue and formed into a compact size. A terminal body (31) includes a bottom wall (31*c*), a pair of side walls (31*a*, 31*b*) each of which stands on one of opposite side ends of the bottom wall (31*c*), and a contact tongue (32) formed on said bottom wall between said side walls. The tongue (32) includes a front spring portion (33) turned back from a front end of said bottom wall (31*c*) between the side walls (31*a*, 31*b*) and a rear spring portion (34) turned back in a U-shape from a rear end of the contact tongue (32) in opposition to the front spring portion (33). Each of the side walls (31*a*, 31*b*) of the terminal body (31) is provided with an engaging hole (36) which is adapted to receive a support projection (35) provided on the distal end of the rear spring portion (34) so that they (36, 35) support the distal end of the contact tongue (32).

3 Claims, 8 Drawing Sheets

TERMINAL AND JOINT CONNECTOR USING THE SAME

BACKGROUND OF THE INVENTION (1) Field of the Invention

This invention relates to a joint connector which accommodates a plurality of terminals in a connector housing to electrically communicate with each other and to a terminal to be contained in the joint connector.

(2) Statement of the Prior Art

Heretofore, a conventional joint connector has been known from, for example, Japanese Patent Public Disclosure No. HEI 6-333628 (1994). For convenience of explanation, a conventional joint connector will be described below by referring to FIG. 11. FIG. 11 is an exploded perspective view of a conventional joint connector.

A terminal 1 includes a bottom wall, a pair of side walls 2, 2 each of which stands on one of opposite ends of the bottom wall, and a contact tongue 3 which is turned back in a U-shape from the front end of the bottom wall between the side walls 2, 2. A connector housing 4 is provided with a plurality of cavities 5 in upper and lower arrays and is also provided between the upper and lower arrays of the cavities 5 with plate-containing chambers 7 which receive a conductive plate 6 having a plurality of tabs. Each plate-containing chamber 7 is communicated with each cavity 5 through each of narrow slots 8 which permits the contact tongue 3 to pass therethrough.

In this structure, after the conductive plate 6 is inserted into the plate-containing chambers 7, the terminal 1 is inserted into the cavity 5 with the contact tongue 3 being directed to the conductive plate 6. The terminals 1 are electrically communicated with each other through contact between the respective contact tongues 3 and the conductive plate 6.

However, the conventional terminal 1 described above is restricted by size. In other words, it is necessary to increase a spring force of the contact tongue 3 in order to maintain a contact pressure between the contact tongue 3 and the conductive plate 6 at a value which is more than a given one. However, since the spring force of the contact tongue 3 in the terminal 1 described above can be obtained only by the single U-shaped bent portion on the proximal end thereof, it is necessary to increase a thickness of the terminal 1 to ensure a sufficient elasticity in that portion. This results in restrictions on the size.

Also, in the conventional construction, if the terminal is inserted into the cavity in a reverse manner, the contact tongue will be subject to an excessive compression force because only one portion performs a spring function. Consequently, the contact tongue will be subject to a great plastic deformation.

SUMMARY OF THE INVENTION

An object of the present invention is to provide a joint connector and a terminal to be used in the joint connector, both of which can be formed into a compact size.

Another object of the present invention is to provide a terminal a contact tongue of which can be prevented from being plastically deformed.

In order to achieve the above objects, in a terminal for a joint connector in accordance with the present invention, a contact tongue of a terminal body comes into contact with a common conductor in a connector housing when the terminal body is inserted into a cavity in the connector housing, thereby bringing a plurality of terminals into an electrical communication with each other through the common conductor in the connector housing. The terminal body includes a bottom wall and a pair of side walls each of which stands on one of opposite side ends of the bottom wall. The tongue includes a front spring portion turned back from a front end of the bottom wall between the side walls and a rear spring portion turned back in a U-shape from a rear end of the contact tongue in opposition to the front spring portion. Each of the side walls is provided with a support means for bearing a distal end of the rear spring portion.

In order to achieve the above objects, a joint connector using the above terminal in accordance with the present invention, comprises: a connector housing having a plurality of cavities; a common conductive plate mounted in the connector housing; and a plurality of terminals each having a terminal body and a contact tongue. The contact tongue comes into contact with the common conductive plate in the connector housing when the terminal body is inserted into a cavity in the connector housing. The terminals are brought into an electrical communication with each other through the common conductive plate in the connector housing. The terminal body includes a bottom wall and a pair of side walls each of which stands on one of opposite side ends of the bottom wall. The tongue includes a front spring portion turned back from a front end of the bottom wall between the side walls and a rear spring portion turned back in a U-shape from a rear end of the contact tongue in opposition to the front spring portion. Each of the side walls is provided with a support means for bearing a distal end of the rear spring portion.

Further, in the above joint connector, one of the side walls of the terminal body is higher than the other side wall. Each of the cavities in the connector housing is provided with an insertion opening which permits the one side wall to enter only when the terminal body is in a regular insertion posture.

In the terminal described above, when a contact load is applied to the contact tongue, the front and rear spring portions on the opposite ends of the contact tongue support the load while being deformed.

In the joint connector described above, if the terminal is inserted into the cavity in a reverse manner, one of the side walls of the terminal abuts against an opening edge of the insertion opening in the cavity, whereby th terminal is unable to enter the cavity.

It will be apparent from the foregoing that according to the terminal and the joint connector using the terminal the load applied on the contact tongue can be supported on the front and rear spring portions, thereby reducing a load to be supported on one spring portion. Accordingly, it is possible to impart sufficient elasticity to the contact tongue even if the terminal is made of a thin metal material and thus to form the terminal and joint connector into a compact size.

In particular, in the joint connector, it is possible to prevent the contact tongue from being plastically deformed by its excessive deformation, because the terminal cannot enter the cavity in a reverse manner.

DETAILED DESCRIPTION OF THE PREFERRED EMBODIMENTS

Embodiments of a terminal and a joint connector using the same in accordance with the present invention will be explained below by referring now to FIGS. 1 to 10.

<First Embodiment>

A first embodiment of the present invention will be explained below by referring now to FIGS. 1 to 6.

Figure 1:
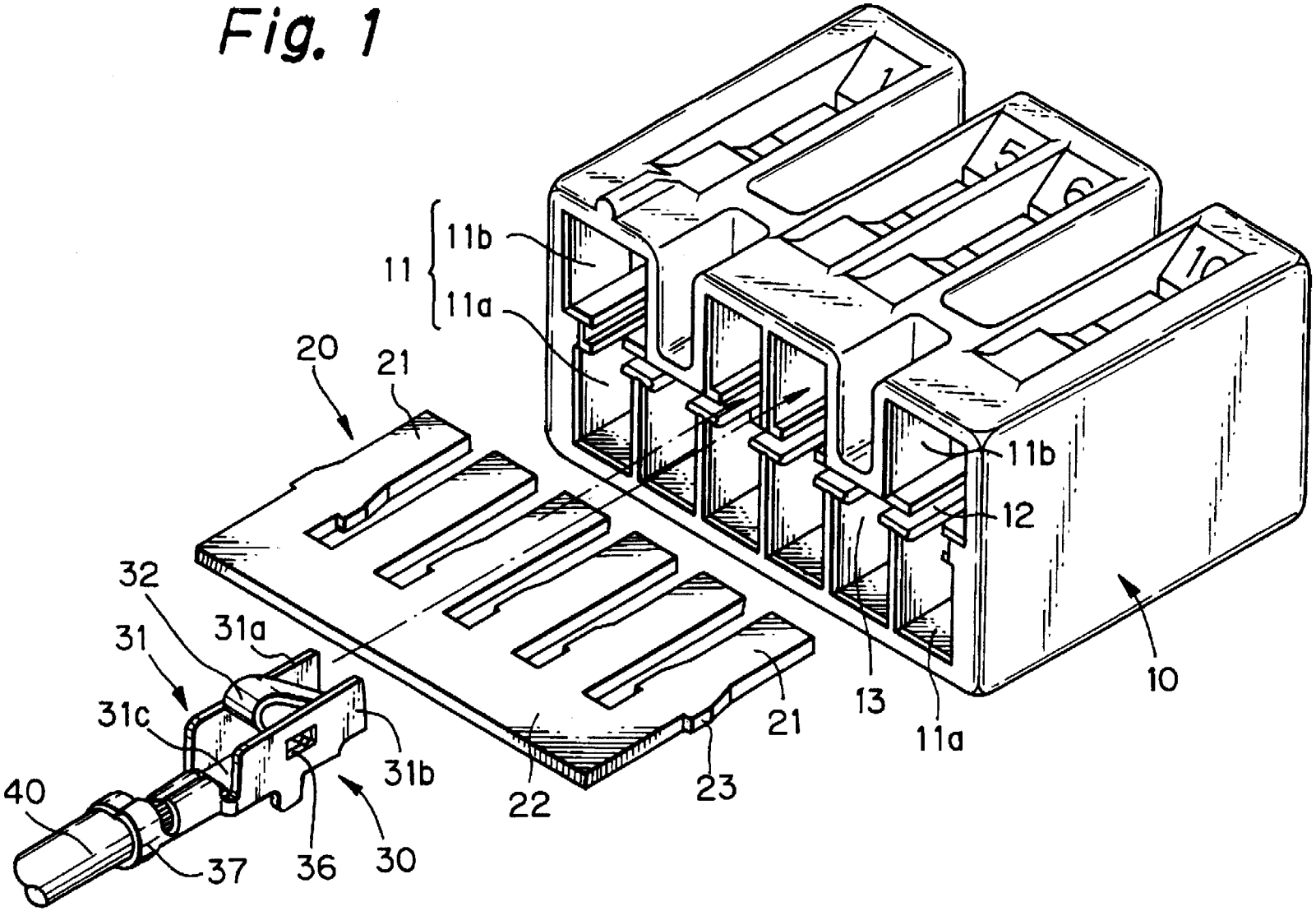
FIG. 1 is an exploded perspective view of a first embodiment of a joint connector in accordance with the present invention.

FIG. 1 is an exploded perspective view of a first embodiment of a terminal and a joint connector in accordance with the present invention.

As shown in FIG. 1, a connector housing 10 is provided with a plurality of cavities 11 disposed in upper and lower arrays and with a plurality of plate-containing chambers 12 which receive a conductive plate 20 between the upper and lower arrays of the cavities 11. A terminal 30 including a pair of side walls 31*a* and 31*b* and a contact tongue 32 projecting from a space between the side walls, as described hereinafter, brings the tongue 32 into contact with the conductive plate 20 accommodated in the plate-containing chambers 12, when the terminal 30 is inserted into the cavity 11, thereby causing the terminals 30 to be electrically communicated with each other.

The connector housing 10 is formed into a box-like body having an opening in an end thereof and is provided with partitions which extend inwardly from the opening to define the cavities 11 in the upper and lower arrays. There are six cavities 11*a* with the same size in the lower array and two cavities 11*b* with a relatively large size at opposite ends and two cavities 11*a* with the same size as that of the lower cavities 11*a* at the middle positions in the upper array. The plate-containing chambers 12 are defined between the upper and lower cavities 11 so as to receive the conductive plate 20. Each cavity 11 is communicated with each plate-containing chamber 12 through each slot 13.

The conductive plate 20 is adapted to be inserted into the plate-containing chambers 12 between the upper and lower cavities 11. The plate 20 is provided on its front end with a plurality of contact tabs 21 and on its rear end with a coupling portion 22 which interconnects the contact tabs 21. Each contact tab is formed into a rectangular shape and is provided on its side edges with detents 23. Each plate-containing chamber 12 is provided with vertical coupling walls in connection with the contact tab 21 so that the detents 23 on the tab 21 slide on the coupling walls when the plate 20 is inserted into the chamber 12 and the detents 23 are locked on the coupling walls when the detents reach a regular position.

Figure 2:
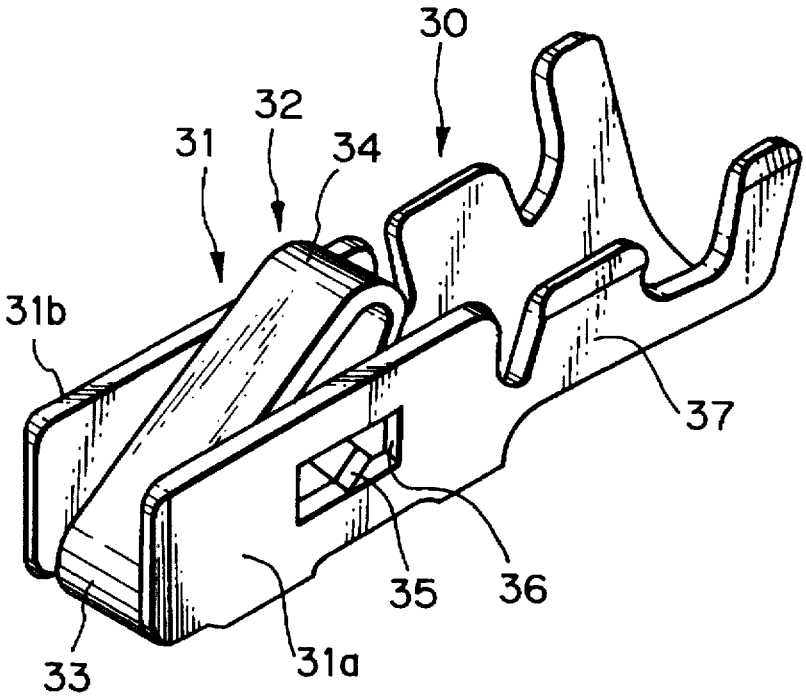
FIG. 2 is an enlarged perspective view of a first embodiment of a terminal in accordance with the present invention.
Figure 3:
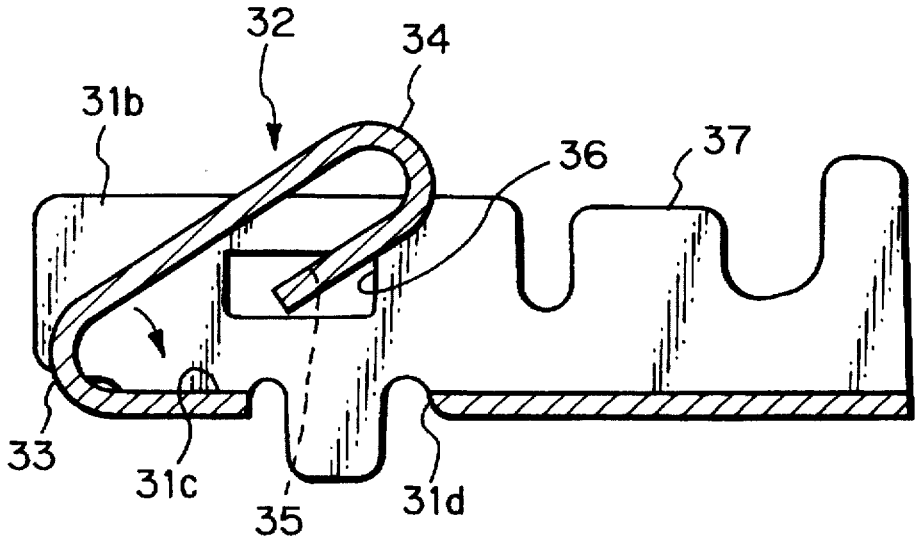
FIG. 3 is an enlarged longitudinal sectional view of the terminal shown in FIG. 2.
Figure 4:
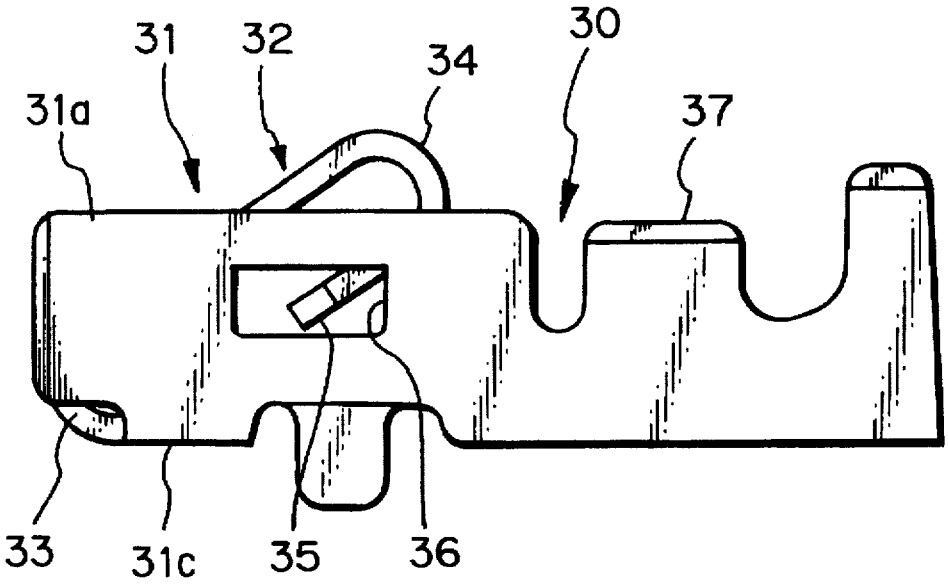
FIG. 4 is an enlarged side elevational view of the terminal shown in FIG. 2.
Figure 5:
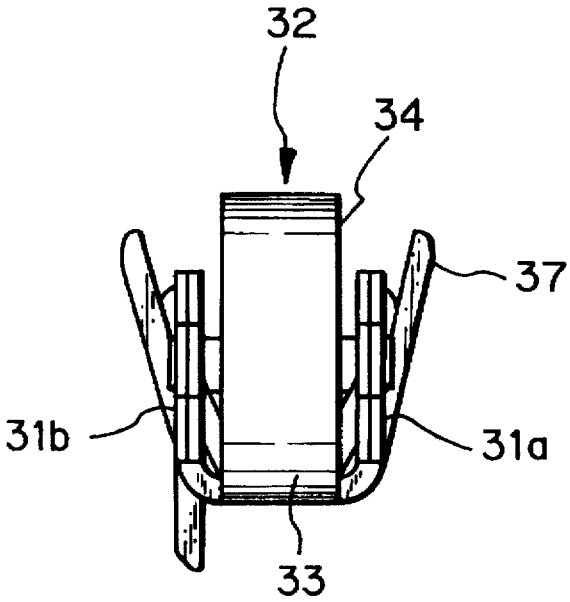
FIG. 5 is an enlarged front elevational view of the terminal shown in FIG. 2.

On the other hand, a terminal body 31 of the terminal 30 includes a bottom wall 31*c*, a pair of side walls 31*a* and 31*b* each of which stands on one of opposite side ends of the bottom wall 31*c* to define a channel, a contact tongue 32 turned back from the front end of the bottom wall 31*c* between the pair of side walls 31*a*, 31*b*, and a barrel portion 37 provided on the rear end of the bottom wall 31*c* for clamping an electrical cable 40. As shown in FIGS. 2 and 3, the contact tongue 32 includes a U-shaped front spring portion 33 turned back from the front end of the bottom wall 31*c* between the side walls 31*a* and 31*b* and a U-shaped rear spring portion 34 turned back from the rear end of the contact tongue 32 in opposition to the front spring portion 33. The rear spring portion 34 is provided on opposite sides of the free end with a support projection 35. Each of the side walls 31*a*, 31*b* of the terminal body 31 is provided with an elongated engaging hole 36 which receives each support projection 35. The projections 35 and holes 36 constitute a support means for supporting the distal end of the rear spring portion 34. The bottom wall 31*c* of the terminal body is provided with a lock hole 31*d*. The connector housing 10 is provided with a lance 16 (FIG. 6) made of a resin material, which is adapted to engage with the lock hole 31*d*.

Next, assembling steps of this embodiment will be described below.

First, the conductive plate 20 is inserted into the connector housing 10. When the conductive plate 20 is completely inserted into the housing 10, each contact tab 21 of the plate 20 is opposed to each cavity 11 through each slot 13.

Second, the terminal 30 clamping the electrical cable 40 is inserted into each cavity 11. Upon insertion of the terminal 30, the contact tongue 32 slides forwardly on the contact tab 21 of the plate 20 white being elastically deformed. When the resin lance 16 in the cavity 11 engages with the lock hole 31*d* in the terminal 30, it is locked in the cavity 11.

In this position, the contact tongue 32 of each terminal 30 comes into contact with each contact tab 21 of the conductive plate 20 and the respective cables 40 connected to the respective terminals 30 are electrically interconnected through the conductive plate 20.

Figure 6:
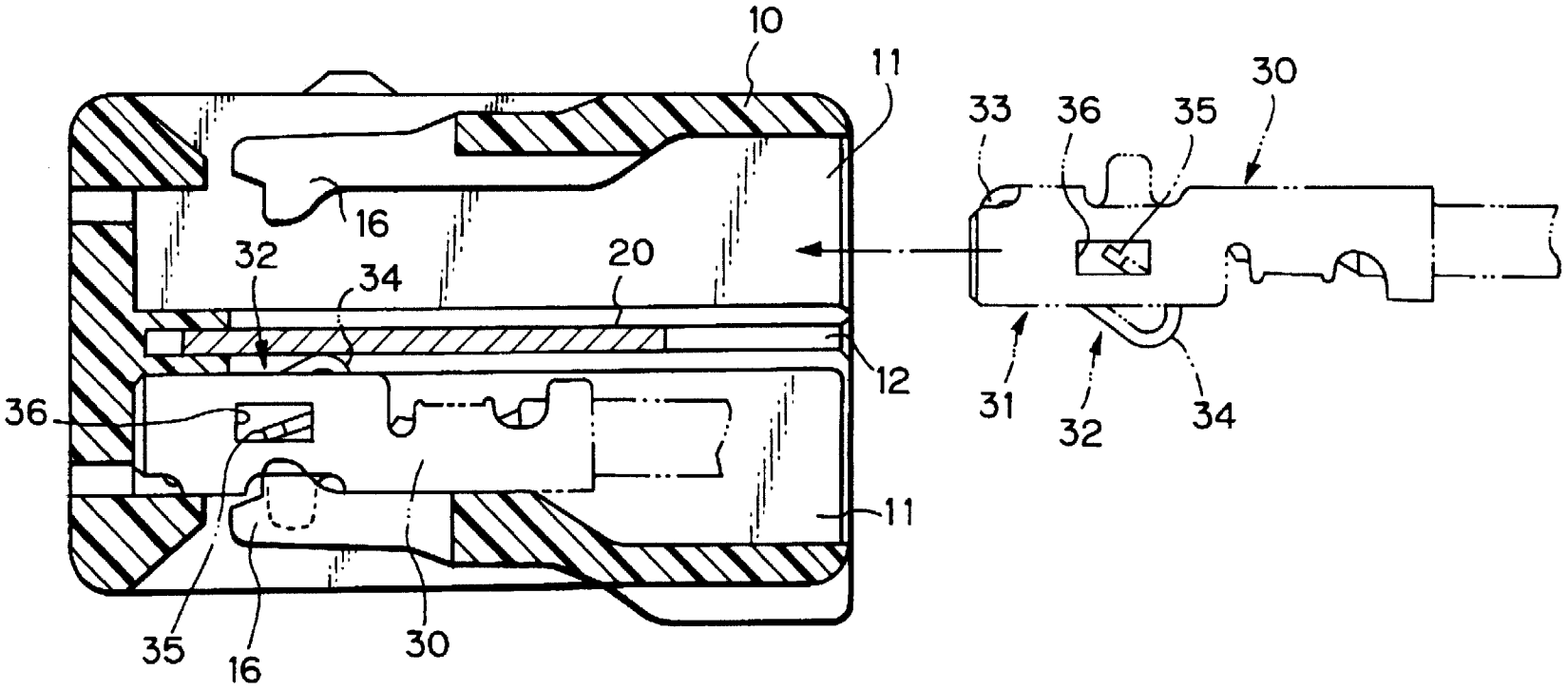
FIG. 6 is a longitudinal sectional view of the joint connector shown in FIG. 1.
Figure 7:
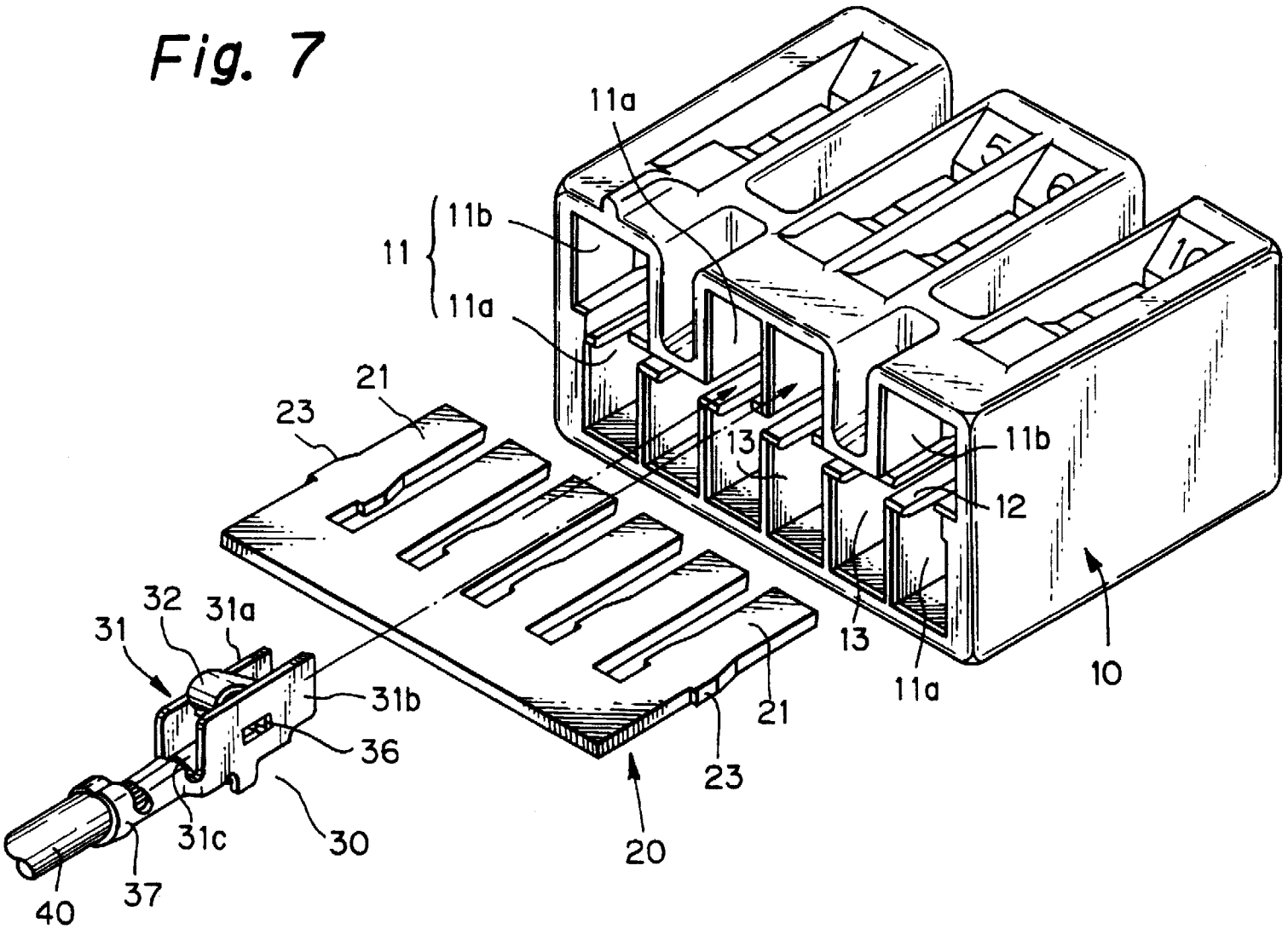
FIG. 7 is an exploded perspective view of a second embodiment of a joint connector in accordance with the present invention.

The contact tongue 32 of the terminal 30 is changed from a free position as shown in an upper stair in FIG. 6 to a contact position as shown in a lower stair in FIG. 6. Consequently, the front and rear spring portions 33 and 34 are elastically deformed. The front spring portion 33 is elastically deformed in a direction shown by an arrow in FIG. 3 when the rear spring portion 34 is pushed down by the conductive plate 20, while the rear spring portion 34 is elastically deformed when the support projections 35 on the distal free end of the portion 34 is born in the engaging hole 36. Thus, both front and rear spring portions 33, 34 can support a contact load with the conductive plate 20 when they are elastically deformed. The terminal of the present invention can reduce the load per support point in comparison with the conventional terminal which bears the load on only one support point. Accordingly, it is possible according to the present invention to give a sufficient elasticity to the contact tongue even if the terminal is made of a thin metal strip and it is also possible to form the terminal 30 and joint connector into a compact size.

If the contact tongue 32 of the terminal 30 should be manually clamped during a step of assembling the joint connector, the tongue 32 is surely prevented from being accidentally deformed because a pushing-down force to the tongue 32 is distributed into two support points. Thus, it is possible to produce a joint connector having a stable quality.

<Second Embodiment>

FIGS. 7 to 10 show a second embodiment of the present invention. The second embodiment differs from the first embodiment with respect to the fact that the side walls 31*a* and 31*b* of the terminals 30 are different in height and the inlet mouths in the connector housing 10 are different in shape in connection with the different heights of the side walls 31*a*, 31*b*. The other structures in the second embodiment are the same as those in the first embodiment.

Figure 8:
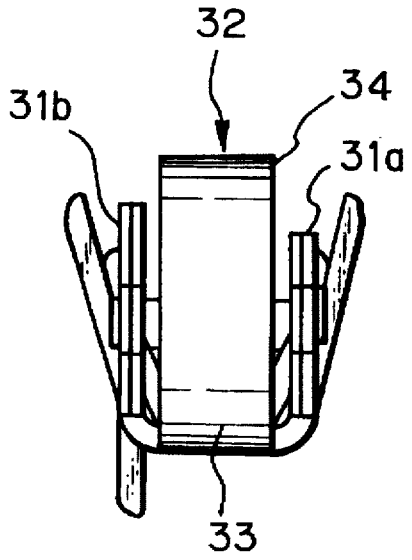
FIG. 8 is an enlarged front elevational view of a terminal shown in FIG. 7.
Figure 9:
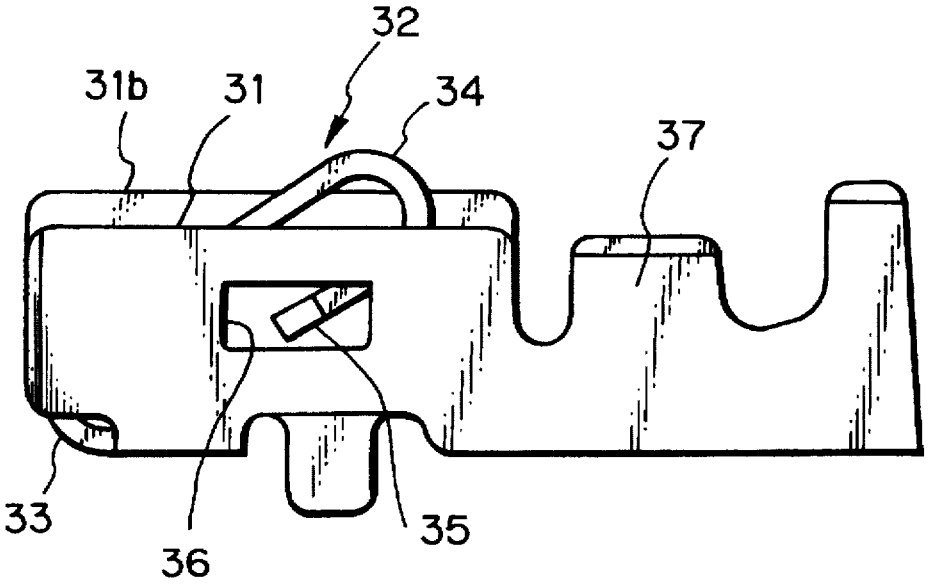
FIG. 9 is an enlarged side elevational view of the terminal shown in FIG. 7.

As shown in FIG. 8, the side walls 31*a* and 31*b* of the terminal body 31 are different in height. For instance, a right side wall 31*a* in FIG. 8 is short and a left side wall 31*b* is tall. As shown in FIG. 9, the side wall 31*b* is taller than the side wall 31*a* through a whole length of the terminal 30 in the insertion direction. The height of the side wall 31*b* is set so that the side wall 31*b* substantially comes into contact with the conductive plate 20 when the terminal 30 is inserted into the cavity 11.

Figure 10:
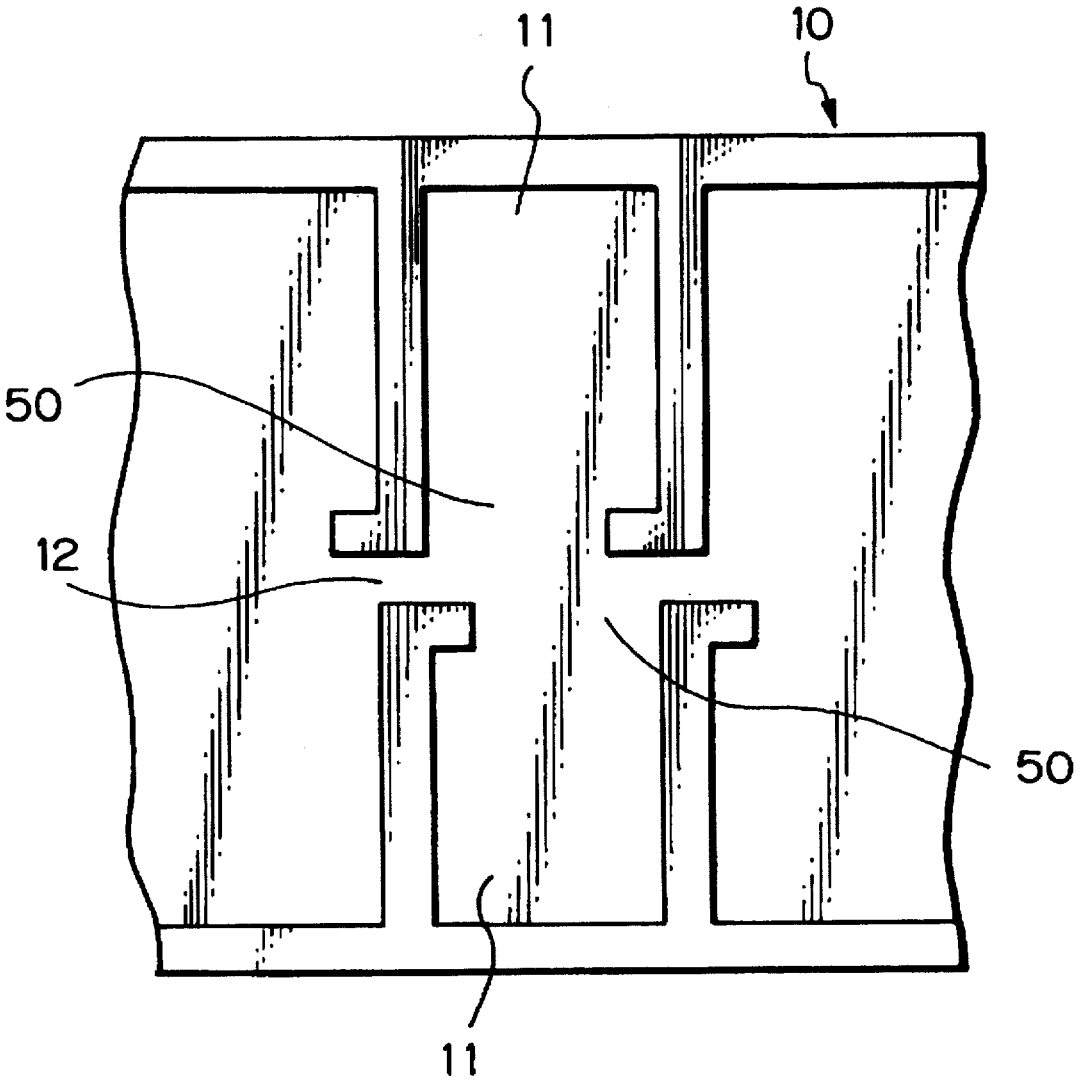
FIG. 10 is a fragmentary enlarged front elevational view of a connector housing shown in FIG. 7.
Figure 11:
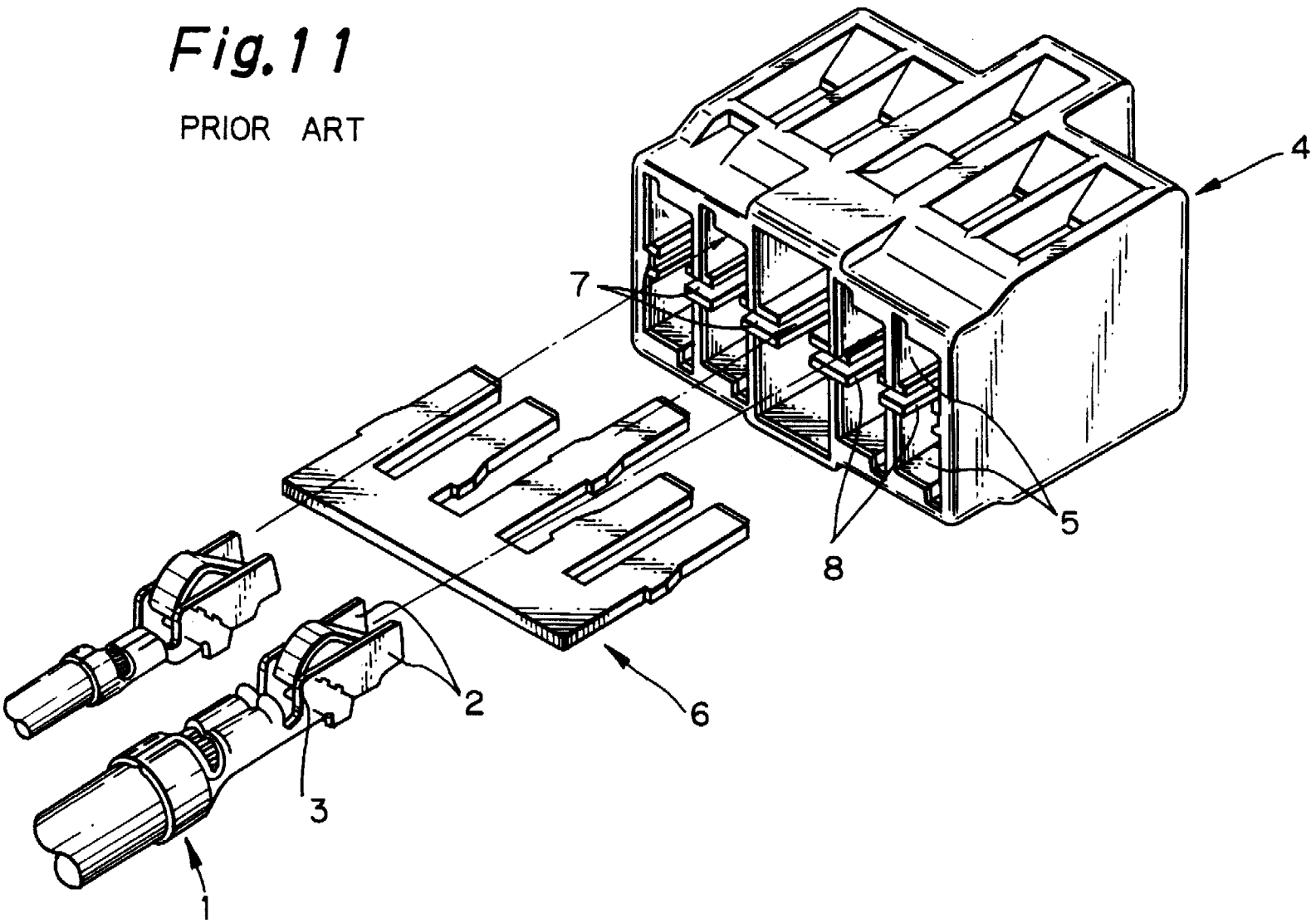
Fig. 11 PRIOR ART
FIG. 11 is an exploded perspective view of a conventional joint connector.

On the other hand, when the terminal body 31 is inserted into the cavity 11 in the connector housing 10 in the regular posture, as shown in FIG. 10, the cavity 11 defines an insertion opening 50 which permits the tall side wall 31*b* to enter the inner part of the cavity 11. Consequently, the terminal 30 can enter the cavity 11 if the terminal 30 is inserted into the cavity in the regular posture, but the terminal 30 cannot enter the cavity 11 if the terminal 30 is inserted into the cavity 11 in a reverse manner, because the tall side wall 31*b* abuts on the edge around the insertion opening 50 to preclude the wall 31*b* from entering the cavity 11.

According to the second embodiment, it is possible to reduce a load per a support point because the contact tongue 32 is supported by the front and rear spring portions 33 and 34, in the same manner as the first embodiment, in comparison with the prior terminal in which the tongue is supported by only one point. In addition, it is possible to prevent the contact tongue from being accidentally pressed and plastically deformed by the reverse insertion of the terminal 30 because the reverse insertion can be avoided beforehand.

<Other Embodiments>

The present invention should not be limited to the above embodiments. For example, the following alterations can be included in the technical scope of the present invention.

(1) Although the above embodiments obtain common conductive communication by contact between each terminal 30 and the conductive plate 20, the common conductive communication may be obtained by contact between the contact tongue of a terminal in a cavity and a part of another terminal in an adjacent cavity.

(2) Although the one side wall 31*b* is taller than the other side wall 31*a* over a whole length in the second embodiment, the one side wall 31*b* may be tall only at the front end.

(3) Each side wall may be provided with a slotted tab bent inwardly in the terminal body so that the slotted tab bears the support projection on the distal end of the tongue against the deflection of the tongue.

(4) Although the terminal is locked by the resin lance in the connector housing in the above embodiments, a projection formed in the terminal body, so called "metal lance" may be locked in the connector housing.

What is claimed is:

1. A terminal for a joint connector wherein a contact tongue of a terminal body comes into contact with a common conductor in a connector housing when said terminal body is inserted, in an insertion direction, into a cavity in said connector housing, thereby bringing a plurality of terminals into an electrical communication with each other through said common conductor in said connector housing, characterized in that:

said terminal body includes a bottom wall and a pair of side walls each of which stands on one of opposite side ends of said bottom wall;

said tongue includes a front spring portion turned back from a front end of said bottom wall between said side walls and a rear spring portion turned back in a U-shape from a rear end of said contact tongue in opposition to said front spring portion; and a support projection extending laterally from each side of said tongue at a distal end of said rear spring portion, a hole in each of said side walls, each said hole having a first side, elongated in said insertion direction, and a second side, elongated in said insertion direction, said second side being farther from said rear spring portion than said first side, each said support projection in said hole bearing against said second side when said terminal body is in said cavity.

2. A joint connector comprising:

a connector housing having a plurality of cavities;

a common conductive plate mounted in said connector housing; and a plurality of terminals each having a terminal body and a contact tongue, said contact tongue coming into contact with said common conductive plate in said connector housing when said terminal body is inserted into a cavity in said connector housing, whereby said terminals are brought into an electrical communication with each other through said common conductive plate in said connector housing;

wherein said terminal body includes a bottom wall and a pair of side walls each of which stands on one of opposite side ends of said bottom wall, wherein said tongue includes a front spring portion turned back from a front end of said bottom wall between said side walls and a rear spring portion turned back in a U-shape from a rear end of said contact tongue in opposition to said front spring portion, and a support projection extending laterally from each side of said tongue at a distal end of said rear spring portion, a hole in each of said side walls, each said hole having a first side, elongated in said insertion direction, and a second side, elongated in said insertion direction, said second side being farther from said rear spring portion than said first side, each said support projection in said hole bearing against said second side when said terminal body is in said cavity.

3. A joint connector according to claim 2, wherein one of said side walls of said terminal body is higher than the other side wall, and wherein each of said cavities in said connector housing is provided with an insertion opening which permits said one side wall to enter only when said terminal body is in a regular insertion posture.

* * * * *